US006125676A

United States Patent [19]

Okuno

[11] Patent Number: 6,125,676

[45] Date of Patent: Oct. 3, 2000

[54] CONTROL SYSTEM FOR CONTROLLING A ROD MILL

[76] Inventor: Toshikazu Okuno, 5-10, Chihara-cho 1, Izumiotu-shi, Osaka-Fu, Japan

[21] Appl. No.: 09/442,134

[22] Filed: Nov. 18, 1999

[30] Foreign Application Priority Data

Nov. 25, 1998 [JP] Japan ..... 10-334233

[51] Int. Cl.[7] ..... B21B 37/08; B21F 11/00

[52] U.S. Cl. ..... 72/20.2; 72/132

[58] Field of Search ..... 72/132, 20.1, 21.1, 72/20.4, 20.2; 83/76.1, 76.6, 202, 263

[56] References Cited

U.S. PATENT DOCUMENTS 3,972,214 8/1976 Jagersberger ..... 72/132
5,438,746 8/1995 Demarest et al. ..... 72/423
5,727,435 3/1998 Wentzek ..... 72/132

FOREIGN PATENT DOCUMENTS 5-261462 10/1993 Japan .
10-76340 3/1998 Japan .

*Primary Examiner*—Rodney A. Butler
*Attorney, Agent, or Firm*—Griffin & Szipl, P.C.

[57] ABSTRACT

A control system for controlling a rod mill wherein a general-purpose motor can be used together with servomotors in controlling the operational sequence of processes, wherein the time required for going through all the processes can be reduced, and wherein the control system can function without imparting any extra load on a controller incorporated therein.

5 Claims, 7 Drawing Sheets

FIG.4

| | ANGLE OF ROTATION OF CAMSHAFT | FEED OF MATERIAL | BENDING | PITCH SETTING |
|---|---|---|---|---|
| 1 | 50° | 50.0mm | | |
| 2 | 20° | | 21mm | |
| 3 | 20° | 15mm | 21mm | |
| 4 | 15° | | 21mm | 5mm |
| 5 | 100° | 60mm | 21mm | 5mm |
| 6 | 20° | | 21mm | −5mm |
| 7 | 15° | 8mm | 21mm | |
| 8 | 25° | | −21mm | |
| 9 | 35° | 30mm | | |
| 10 | 60° (CUTTING OFF) | | | |
| | A PRODUCT IS MANUFACTURED EVERY TIME CAMSHAFT ROTATES THROUGH 360° | | | |

NO.1 FEED OF MATERIAL(THROUGHT A PAIR OF ROLLS)

NO.2 BENDING(WITH A BENDER)

NO.3 FURTHER BENDING(BY ROLL DRIVE)

NO.4 PITCH SETTING (WITH PITCH SETTING MECHANISM)

NO.5 FEED OF MATERIAL (BY ROLL DRIVE)

NO.6 RETRIEVING PITCH SETTING MECHANISM

NO.7 FEED OF MATERIAL

NO.8 RETRIEVING THE BENDER

NO.9 FEED OF MATERIAL (BY ROLL DRIVE)

NO.10 CUTTING OFF A PRODUCT

CONTROL SYSTEM FOR CONTROLLING A ROD MILL

FIELD OF THE INVENTION

This invention relates to a control system for controlling a rod mill by the utilization of servomotors.

BACKGROUND OF THE INVENTION

In order to subject several moving parts to computerized control, it has been conventional practice in the past to give commands on the basis of a stored program, check to see, at intervals of, e.g., a hundredth of a second, that each of the moving parts has moved punctually to a prescribed position, and answer for trouble-free operation by generating a correcting signal when there is something amiss.

In prior art, only the moving parts connected to servomechanisms such as servomotors can be subjected to the correction of speed, etc. Even if each of the moving parts can afford to develop a higher speed, the time required for going through all the processes cannot be shortened. This is because time is required for checking to see that each of the moving parts has moved in strict accordance with a command.

In case where all the moving parts are adapted to be actuated in movement by respective cams mounted on a single camshaft driven by means of a motor such as a general-purpose motor in which rotational speed is directly related to voltage, the prior art has never provided an effective way of connecting these moving parts to servomotors for the purpose of computerized control.

SUMMARY OF THE INVENTION

It is, therefore, the object of the invention to eliminate the drawbacks of hitherto known control systems and to provide a control system for controlling a rod mill wherein a general-purpose motor can be used together with servomotors in controlling the operational sequence of processes, wherein the time required for going through all the processes can be reduced, and wherein the new and improved control system can function without imparting any extra load on a computer incorporated therein.

The foregoing object is attained by means of a general-purpose motor associated with signal generators adapted to generate an output signal every time a camshaft has rotated through a unit angle of rotation, a plurality of servomotors incorporating drive circuits capable of effecting the feed of a material, pitch setting, and sliding mode control respectively, and a controller connected to these servomotors and provided with means for analyzing and determining, on the basis of data on the operational sequence of processes and on the workload to be allotted in sequence, which count should actuate which servomotor, how many output signals generated by the signal generators should correspond to the workload to be allotted in sequence, and how much workload should be allotted to a time interval between an instant when an output signal is generated and an instant when another output signal immediately succeeding thereto is generated. The results of determination are transmitted to, and stored in, the drive circuits incorporated in the servomotors. The signal generators transmit the output signals to the servomotors and the controller so as to allow the servomotors to carry out the processes at opportune moments and in proper quantity and allow the controller to check to see that the servomotors are carrying out the processes accordingly.

It is also contemplated that a cutter is provided, by means of which the material is cut off in the last process of the rod mill. This is effected by the camshaft revolving through a predetermined angle of revolution.

Preferably, the camshaft makes a complete revolution for 3,600 output signals to be generated by the signal generators.

BRIEF DESCRIPTION OF THE DRAWINGS

FIG. 4 provides an example of control data to be provided to a controller so as to permit the same to control successive processes;

DESCRIPTION OF THE PREFERRED EMBODIMENTS

Figure 1:
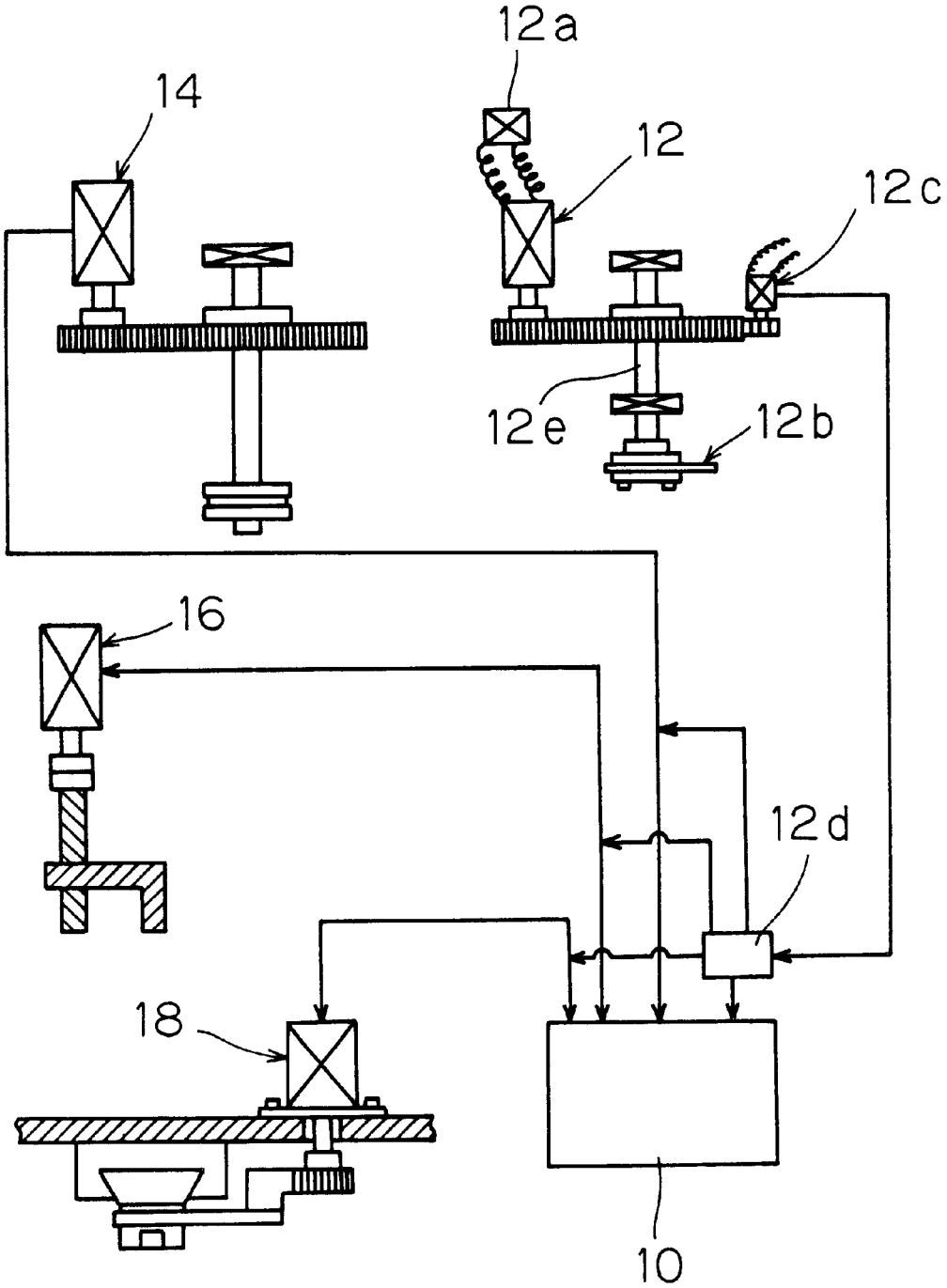
FIG. 1 is a system diagram of an embodiment of the invention.

Referring now to FIG. 1, a control system embodying this invention includes a computer incorporated in a controller 10. Heretofore, a computer incorporated in a controller has been utilized to give commands to start all kinds of operation. By contrast, the computer incorporated in the controller 10 is used as means for writing a list of products to be manufactured and as means for analyzing and determining various parameters. This important facet of the invention obviates the necessity of detecting the position of each moving part. The control system embodying this invention further includes a plurality of servomotors 14, 16 and 18, each of which incorporates a drive circuit having a memory for storing data supplied by the computer and intended for use in starting specific kinds of operation in response to specific signals. A chain extends around a driving gear fixed to a shaft from a general-purpose motor 12 and driven gears respectively fixed to shafts which provide operating association or connection with the moving parts of a rod mill. The shafts to which the driven gears are respectively fixed are driven so that any one of them will make one revolution for each one revolution made by another one of them. A change in the rotational speed caused by a change in voltage is ignored.

The control system embodying this invention further includes a camshaft 12*e*, the cylindrical surface of which is equally circumferentially segmented into, e.g., 3,600 portions so that an encoder 12*c* may generate an output signal every time the camshaft 12*e* has rotated through a unit angle of 0.1°. The aforesaid memory incorporated in each servomotor stores data on the unit quantity of work to be done during a time interval between an instant when an output signal is generated and an instant when another output signal immediately succeeding thereto is generated. Therefore, when the general-purpose motor 12 is stopped, the servomotor is put out of operation, because the encoder 12*c* stops generating an output signal. Another caution should be exercised in case where the encoder 12*c* generates output signals at long intervals because the camshaft 12*e* is rotated at a low speed. Even if the aforesaid time interval is lengthened in this manner, the aforesaid unit quantity of work to be done by each servomotor is unchanged. In this case, therefore, the servomotor is stopped when it has done the work to such an extent as stored in the memory.

Figure 2A:
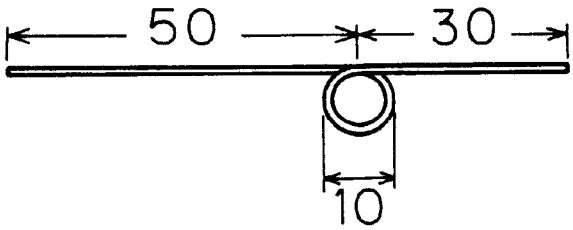
FIG. 2(A) is a front view of an illustrative example of a product to be manufactured with a rod mill.
Figure 2B:
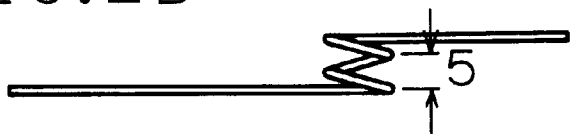
FIG. 2(B) is a top plan view thereof.
Figure 3:
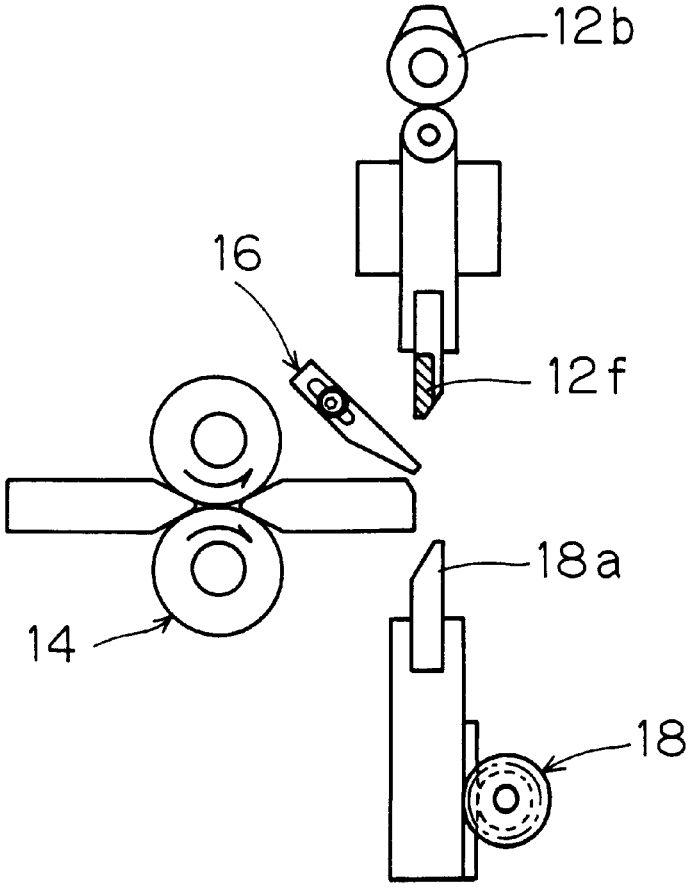
FIG. 3 is a view showing certain components of the rod mill arranged for carrying out a process.

In FIG. 2, we see an illustrative example of a product to be manufactured with the rod mill. In accordance with the shape of the product and in order of the operational sequence of processes, data on which one of the servomotors 14, 16 and 18 should be set in motion and how long it should be in motion are provided to the computer incorporated in the controller 10. FIG. 4 provides an example of such data.

Upon receipt of these data, the computer evaluates the quantity of work to be done by each of the shafts from the servomotors 14, 16 and 18 during a time interval between an instant when a specific one of output signals is received from the encoder 12*c* and a decoder 12*d* and an instant when another specific one of the output signals is received therefrom as well as the unit quantity of work to be done during a time interval between an instant when an output signal is generated and an instant when another output signal immediately succeeding thereto is generated. The results of evaluation is stored in a storage element of the drive circuit incorporated in each servomotor. A microprocessor incorporated in each servomotor performs operations in accordance with a list of instructions stored in the drive circuit.

Figure 5:
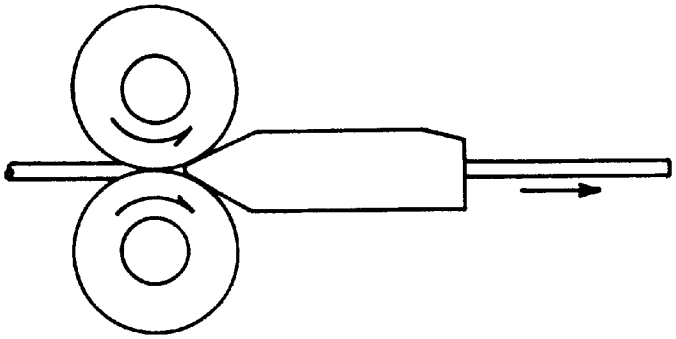
FIGS. 5 to 8 provide a diagrammatic illustration of successive processes, on which control data are shown in FIG. 4.
Figure 5:
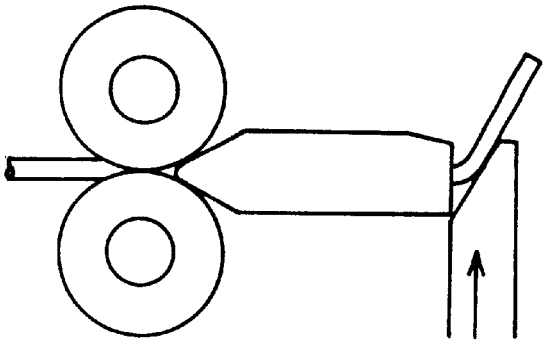
Figure 5:
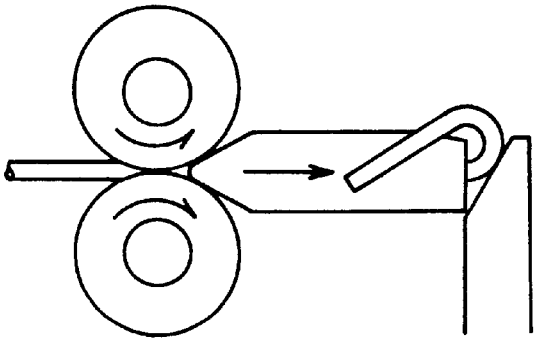
Figure 6:
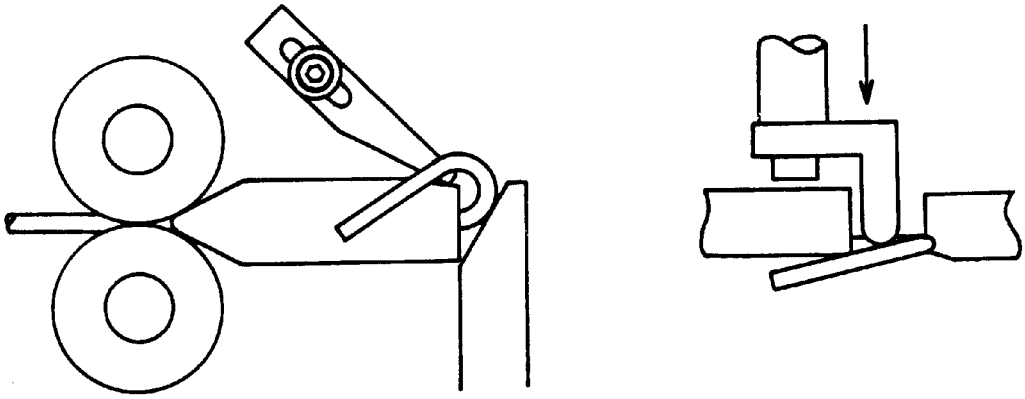
Figure 6:
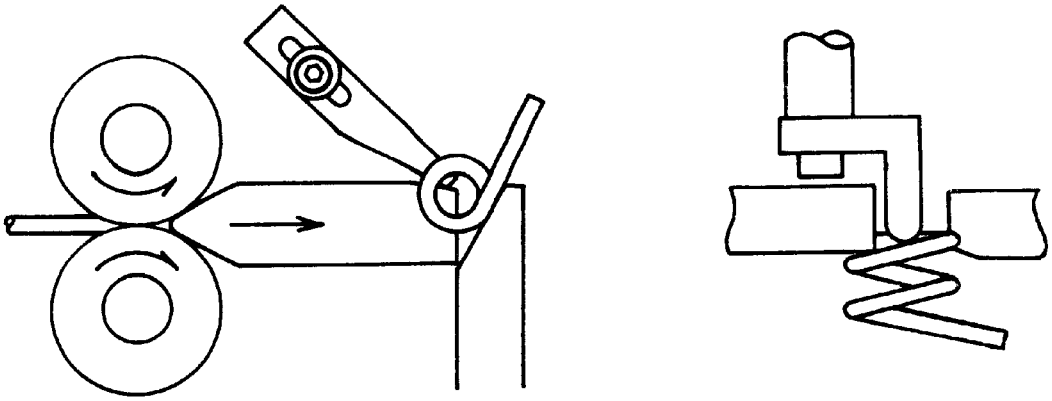
Figure 6:
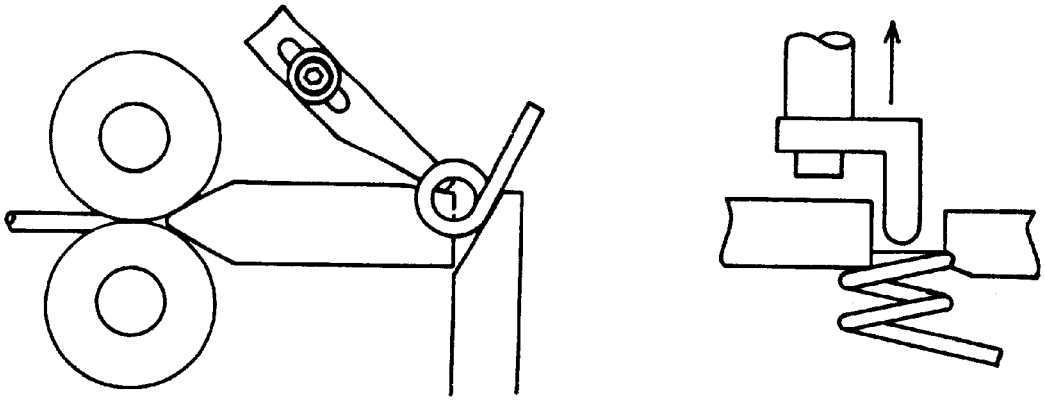
Figure 7:
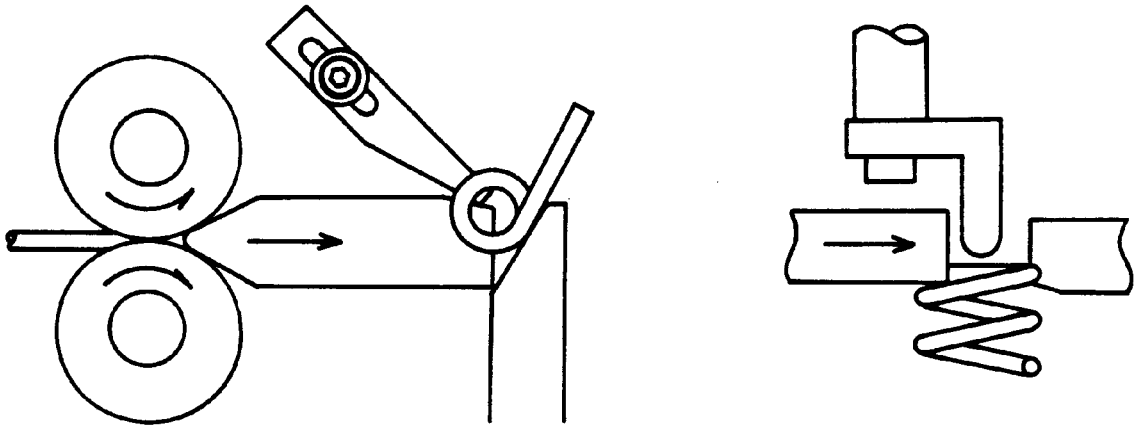
Figure 7:
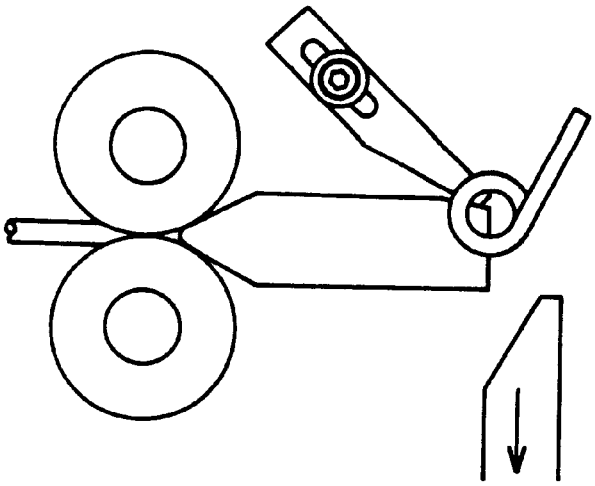
Figure 8:
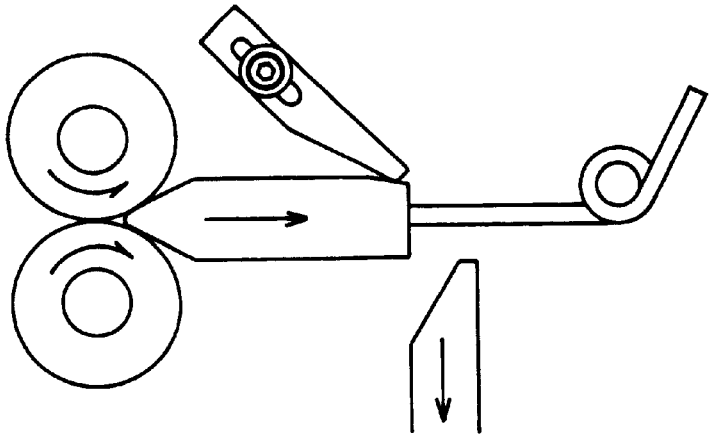
Figure 8:
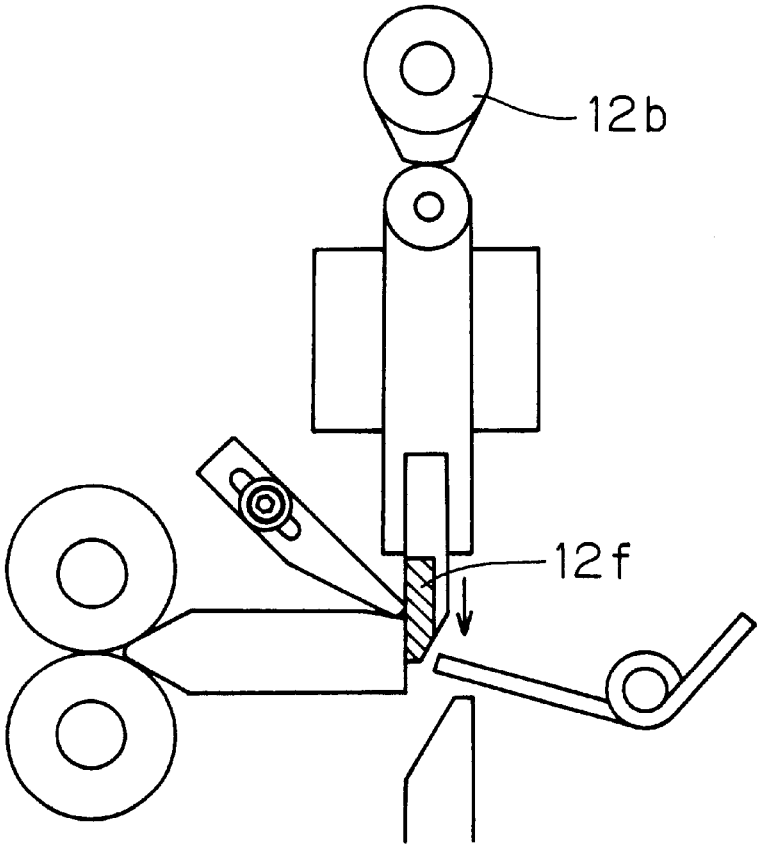

In FIG. 4, the angles of rotation through which the camshaft 12*e* is rotated in the first to tenth processes respectively are shown in the second column from the left, while the feed lengths by which the material is fed in the several processes respectively are shown in the central column. The first process, in which the material is fed by a feed length of 50 mm, is commenced by a first output signal generated by the encoder 12*c* and transmitted to the servomotor 14 to which the feed of the material is assigned. This process is shown in No. 1 of FIG. 5. During this process, the camshaft 12*e* is rotated through an angle of 50°. As aforesaid, the encoder 12*c* generates an output signal every time the camshaft 12*e* has rotated through a unit angle of 0.1°. This means that, during this process, the encoder 12*c* generates 500 output signals for feeding the material by a feed length of 50 mm. Consequently, the material is fed by a feed length of 0.1 mm during a time interval between an instant when an output signal is generated and an instant when another output signal immediately succeeding thereto is generated. The servomotor 14 continues to be in motion until a 500th output signal is generated by the encoder 12*c* and transmitted to the servomotor 14. The second process, in which the servomotor 18 is set in motion, is commenced by a 501st output signal. During this process, the first bending is carried out with a bender 18*a* as shown in No. 2 of FIG. 5. This process is followed by the third process (No. 3 of FIG. 5) to the ninth process (No. 9 of FIG. 8). The material is cut off in the last process (No. 10 of FIG. 8) so as to form a product.

The camshaft 12*e* has a cam member 12*b* fixed thereto in alignment with a severing assembly so that, upon rotary movement of the camshaft 12*e* through an angle of 60° in the last process (No. 10 of FIG. 8), the cam member 12*b* may actuate a cutter 12*f* for cutting the material in vertical downward movement in the conventional way. It will of course be apparent to those skilled in the art that this severing assembly may be readily replaced by means for placing an indentation in the material to create a permanent deformation which will insure that, when the material is bent along this indentation, the product will be severed from the remaining portion of the material.

The drive circuit incorporated in any of the servomotors 14, 16 and 18 generates a signal indicating the occurrence of abnormality if the servomotor involved begins failing to keep up with a train of output signals generated by the encoder 12*c*. The controller 10 stops the rod mill upon receipt of the signal indicating the occurrence of abnormality.

It is contemplated that the control system embodying this invention will be found equally advantageous when it further includes an inverter 12*a* capable of increasing the rotational speed of the camshaft 12*e* to such an extent that any of the servomotors 14, 16 and 18 comes to be on the brink of failing to keep up with a train of output signals generated by the encoder 12*c*. The rotational speed of the camshaft 12*e* increased to this extent renders the operation of the rod mill most efficient.

The operation of the rod mill is controlled by the aforesaid 3,600 output signals to be generated by the encoder 12*c* during the time when the camshaft 12*e* rotates through an angle of 360°. This means that the controller 10 does not concern itself with the control over the operation of the rod mill. Consequently, the control system embodying this invention can function without imparting any extra load on the computer incorporated in the controller 10. Incidentally, the aforesaid 3,600 output signals are provided also to this computer so as to allow this computer to monitor the eventual occurrence of abnormality.

It has been conventional practice in the past for a controller to generate signals indicating the timing of allowing each servomotor to begin to operate and the quantity of work to be done thereby, check to see that each servomotor is doing the work in strict accordance with the command received from the controller, and, when the running speed of a servomotor lags behind that of others, generate a correcting signal for conforming the latter to the former. For this purpose, the prior art controller has performed evaluation on the basis of data entered via input means. These functions to be fulfilled by the prior art controller have imparted a heavy load on the controller. The heaviness of the load has been such that the prior art controller has to be replaced with a supercomputer if the time required for going through all the processes is to be shortened.

Particular advantages obtained from this invention reside in the facts that a general-purpose motor can be used together with servomotors in controlling the operational sequence of processes, that the time required for going through all the processes can be reduced, and that the new and improved control system can function without imparting any extra load on a computer incorporated therein.

What is claimed is:

1. A control system for controlling a rod mill comprising:

a general-purpose motor (12) associated with signal generators (12*c*, 12*d*) configured to generate an output signal every time a camshaft (12*e*) has rotated through a unit angle of rotation;

a plurality of servomotors (14, 16, 18, . . . ) incorporating drive circuits for effecting feed of a material, pitch setting, and sliding mode control respectively;

a controller (10) connected to said servomotors and provided with means for analyzing and determining, on the basis of data on an operational sequence of processes and on workload to be allotted in sequence, which count should actuate which servomotor, how many output signals generated by said signal generators should correspond to said workload to be allotted in sequence, and how much workload should be allotted to a time interval between an instant when an output signal is generated and an instant when another output signal immediately succeeding thereto is generated, with results of said determination transmitted to, and stored in, said drive circuits incorporated in said servomotors; and said signal generators transmitting the output signals to said servomotors and said controller so as to allow said servomotors to carry out the processes at opportune moments and in proper quantity and allow said controller to check to see that said servomotors are carrying out the processes accordingly.

2. A control system as defined in claim 1, further including a cutter (12*f*) actuated by said camshaft revolving through a predetermined angle of revolution so as to cut off the material in a last process of the rod mill.

3. A control system defined in claim 1, wherein said signal generators (12*c*, 12*d*) generate 3,600 output signals during the time when the camshaft (12*e*) rotates through an angle of 360°.

4. A control system as defined in claim 1, further including means for placing an indentation in the material to create a permanent deformation which will insure that, when the material is bent along this indentation in a last process of the rod mill, a product will be severed from the remaining portion of the material.

5. A control system as defined in claim 3, further including means for placing an indentation in the material to create a permanent deformation which will insure that when the material is bent along this indentation in a last process of the rod mill, a product will be severed from the remaining portion of the material.

* * * * *